US009594350B2

(12) United States Patent
Sarchi et al.

(10) Patent No.: US 9,594,350 B2
(45) Date of Patent: Mar. 14, 2017

(54) BALANCE SPRING MADE OF MICROMACHINABLE MATERIAL WITH ISOCHRONISM CORRECTION

(71) Applicant: Montres Breguet S.A., L'Abbaye (CH)

(72) Inventors: Davide Sarchi, Renens (CH); Sylvain Marechal, Bois-d'Amont (FR); Polychronis Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/084,787

(22) Filed: Mar. 30, 2016

(65) Prior Publication Data

US 2016/0306324 A1 Oct. 20, 2016

(30) Foreign Application Priority Data

Apr. 16, 2015 (EP) ..... 15163808

(51) Int. Cl.
*G04B 17/06* (2006.01)
*G04B 18/02* (2006.01)
(Continued)

(52) U.S. Cl.
CPC ..... *G04B 17/063* (2013.01); *G04B 15/00* (2013.01); *G04B 17/066* (2013.01); *G04B 18/026* (2013.01); *G04B 17/325* (2013.01)

(58) Field of Classification Search
CPC .... G04B 17/327; G04B 17/32; G04B 17/325; G04B 17/063; G04B 17/066; G04B 15/00; G04B 17/34; G04B 17/04
See application file for complete search history.

(56) References Cited

U.S. PATENT DOCUMENTS 3,154,912 A * 11/1964 Pinkas ..... G04B 17/325 368/170
3,553,956 A * 1/1971 Schwartz ..... G04B 17/325 368/158

(Continued)

FOREIGN PATENT DOCUMENTS

CH 45160 10/1909
CH 256 274 8/1948

(Continued)

OTHER PUBLICATIONS

European Search Report issued Oct. 28, 2015 in European Application 15163808, filed on Apr. 16, 2015 (with English Translation).

*Primary Examiner* — Sean Kayes
(74) *Attorney, Agent, or Firm* — Oblon, McClelland, Maier & Neustadt, L.L.P.

(57) ABSTRACT

A timepiece balance spring made of micromachinable material including a plurality of stages, each forming a spiral wound spring, parallel to each other and all attached to a common axial collet or to the same balance staff, each stage including, at its respective outer end, its own attachment to a balance spring stud which are independent of those of the other stages, the attachment including a position adjustment with respect to a balance spring stud which are also independent of those of the other stages, the attachment and the position adjustment together forming built-in isochronism correction mechanism for the balance spring, and the position adjustment including a plurality of discrete position adjustment positions including housings each arranged to retain a stud.

17 Claims, 8 Drawing Sheets

(51) Int. Cl.
*G04B 15/00* (2006.01)
*G04B 17/32* (2006.01)

(56) References Cited

U.S. PATENT DOCUMENTS

| | | | | |
|---|---|---|---|---|
| 3,599,423 | A | 8/1971 | Beguin et al. | |
| 7,889,028 | B2 * | 2/2011 | Hessler | G04B 17/066 310/370 |
| 8,322,914 | B2 * | 12/2012 | Bifrare | G04B 17/066 368/177 |
| 8,480,294 | B2 * | 7/2013 | Helfer | G04B 17/066 368/175 |
| 8,757,868 | B2 * | 6/2014 | Karapatis | G04B 17/066 368/127 |
| 9,004,748 | B2 * | 4/2015 | Helfer | G04B 17/063 368/175 |
| 2009/0236782 | A1 | 9/2009 | Buhler et al. | |
| 2014/0286140 | A1 | 9/2014 | Stranczl et al. | |

FOREIGN PATENT DOCUMENTS

| | | | |
|---|---|---|---|
| CH | 704 677 | A2 | 9/2012 |
| EP | 2 104 006 | A1 | 9/2009 |
| EP | 2 233 989 | A1 | 9/2010 |
| EP | 2 781 967 | A1 | 9/2014 |
| FR | 2 024 511 | | 8/1970 |

* cited by examiner

BALANCE SPRING MADE OF MICROMACHINABLE MATERIAL WITH ISOCHRONISM CORRECTION

FIELD OF THE INVENTION

This application claims priority from European Patent Application No. 15163808.7 filed on Apr. 16, 2015, the entire disclosure of which is hereby incorporated herein by reference.

The invention concerns a timepiece balance spring made of micromachinable material comprising a plurality of stages, each forming a spiral wound spring, all parallel to each other and arranged to be assembled to each other at their respective inner ends in a common axial collet or in the same balance staff, wherein each said stage includes, at its respective outer end, its own means of attachment to a balance spring stud which are independent of those of said other stages, said means of attachment comprising means for position adjustment with respect to a balance spring stud which are also independent of those of said other stages, said means of attachment and said means for position adjustment together forming built-in isochronism correction means for said balance spring.

The invention also concerns an escapement mechanism including such a balance spring.

The invention also concerns an escapement mechanism including at least one sprung balance assembly, wherein the outer end of at least one balance spring is attached to a balance spring stud.

The invention concerns a mechanical timepiece movement including at least one escapement mechanism. The invention concerns a watch comprising at least one mechanical timepiece movement.

The invention concerns the field of timepiece mechanisms including balance springs made of micromachinable material, and more specifically escapement mechanisms.

BACKGROUND OF THE INVENTION

New technologies for the fabrication of balance springs from micromachinable materials, such as silicon, silicon oxide, DLC or similar, implemented by MEMS, DRIE, LIGA or similar methods, have made significant progress, and the springs thus fabricated have significant advantages:

- geometrically, they are very close to nominal geometries, much more consistent than the steel springs of the prior art;
- they have more stable mechanical properties than steel springs, due to the absence of plastic deformation;
- they are non-magnetic;
- they can be made on several stages (especially double springs), and/or with a terminal curve, with increased precision compared to the prior steel spring technology.

However, with this type of spring made of micromachinable material, fine adjustment is greatly limited, because the spring does not have an independent system for adjustment of the mean frequency and isochronism, which can be used after assembly.

If the isochronous gradient is changed by a modification of the active length, the mean frequency of the corresponding sprung balance assembly is greatly modified, and correction of the balance wheel screws is then generally not sufficient to compensate for this error.

However, a conventional steel balance spring can be adjusted independently, even after assembly, as regards its mean frequency and isochronous gradient, through the use of the index assembly, and because plastic deformation of the balance spring is possible.

Moreover, fabrication systems cannot fabricate sprung balances that are sufficiently close to the nominal geometry to ensure increased chronometric performance, since an error on the order of magnitude of a ppm remains even with extremely careful machining.

FR Patent 2024511, in the name of PORTESCAP, describes a regulating device with a double balance spring, the two balance springs being arranged for mutual temperature compensation.

CH Patent 256274, in the name of ERNEST BOREL, describes an index assembly with a movable stud.

EP Patent 2104006, in the name of NIVAROX, describes a one-piece double balance spring with a common collet, notably made of silicon.

EP Patent 2233989, in the name of ULYSSE NARDIN, describes a balance spring whose outer coil is divided into two strips defining an oblong opening for housing an adjustment member other than the stud.

CH Patent 704677, in the name of MHVJ, describes a tourbillon with a particular stud arrangement, arranged to limit the lateral displacement of the balance spring in the event of a shock.

CH Patent 45160, in the name of MONTRES INVAR, describes a balance spring with two stages with independent outer coils.

EP Patent 2781967, in the name of NIVAROX, describes an escapement mechanism with a stud whose position is movable and adjustable.

SUMMARY OF THE INVENTION

The invention therefore proposes to produce a balance spring made of micromachinable material which includes built-in means of adjustment for isochronism.

To this end, the invention concerns a balance spring according to claim 1. The invention also concerns an escapement mechanism according to claim 12.

The invention also concerns a mechanical timepiece movement including at least one such escapement mechanism.

The invention also concerns a watch including at least one mechanical timepiece movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
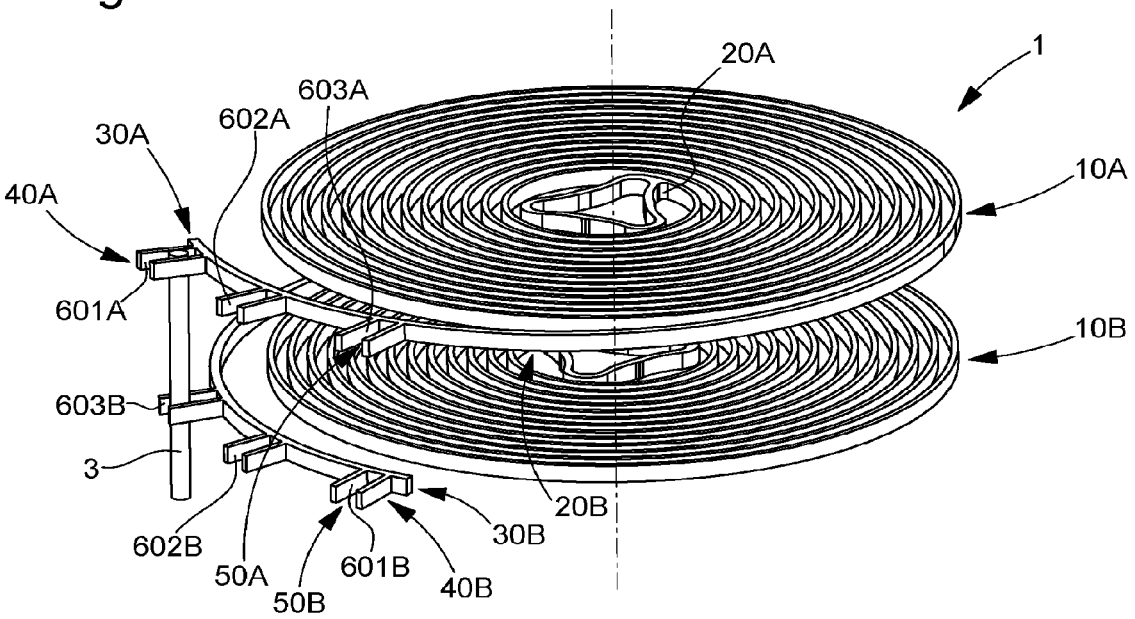
FIG. 1 shows a schematic perspective view of a balance spring according to the invention, comprising two stages of coils cooperating with a single rectilinear stud parallel to the axis of the balance spring, each coil stage including, at its outer end, means for adjustment and attachment to a stud, in a first adjustment position with respect to a single rectilinear stud parallel to the axis of the balance spring.

The invention concerns a timepiece balance spring 1 made of micromachinable material, including but not limited to silicon, or silicon and silicon oxide.

This balance spring 1 includes a plurality of stages 10, which each form a spiral wound spring. Stages 10 are all parallel to each other, and are arranged to be assembled to each other at their respective inner ends 20 in a common axial collet (not shown in the Figures) which may consist of a tube where the respective inner ends 20A, 20B, 20C, . . . are attached, or a similar element, or to be jointly assembled in the same balance staff.

Each stage 10 is made of micromachinable material. In a particular variant, but which, in the current state of technology, is only suitable for certain embodiments where the profiles of the various stages are superposed in the free state of the balance spring, said balance spring 1 is in one-piece.

In most cases, and especially in the embodiments illustrated by the Figures, each stage 10 is made independently, and the final balance spring 1 is produced by assembly in a common collet or directly on a balance 2. Advantageously, each stage 10 then includes angular indexing means arranged to cooperate in a complementary manner with complementary angular indexing means comprised in the other stages, to form together a compound balance spring 1 with a fixed, perfectly reproducible geometry.

The invention is illustrated, in FIGS. 1 to 4 and 7 to 10, in a simplified case with two stages 10A and 10B. This particular variant offers sufficient adjustment precision to suit most timepiece applications. Those skilled in the art will know how to extrapolate the invention to a greater number of stages.

Figure 5:
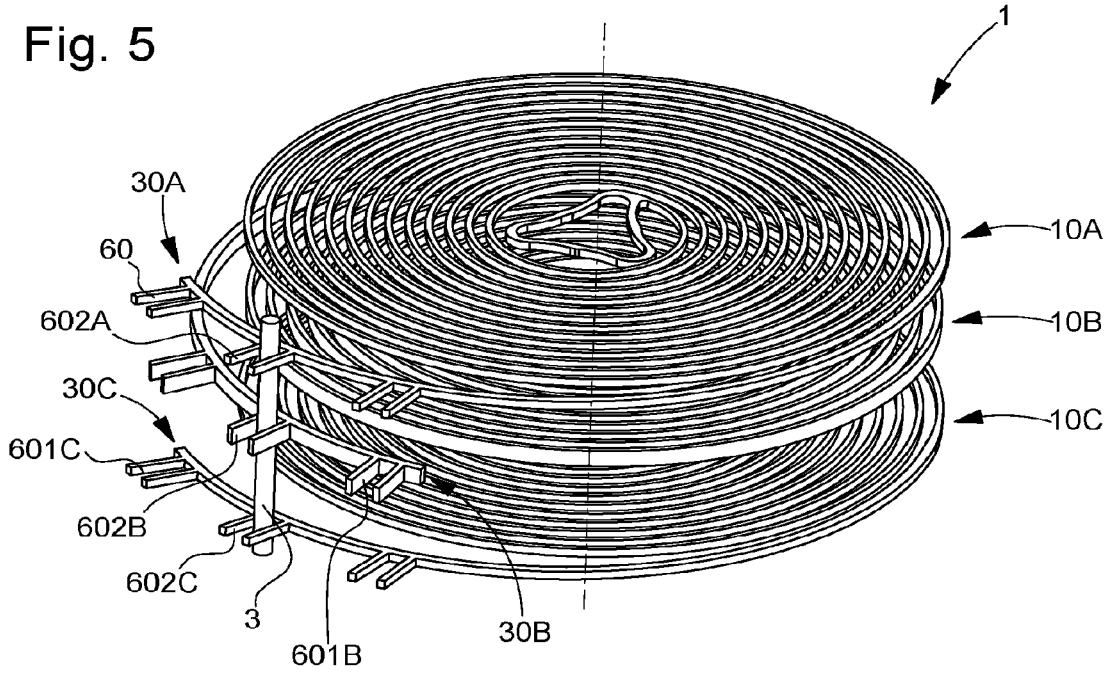
FIG. 5 shows a schematic perspective view of a balance spring according to the invention, including three stages of coils, attached to a single rectilinear stud which is parallel to the axis of the balance spring, in a specific adjustment position wherein the two outer coils are superposed in projection in relation to each other.
Figure 6:
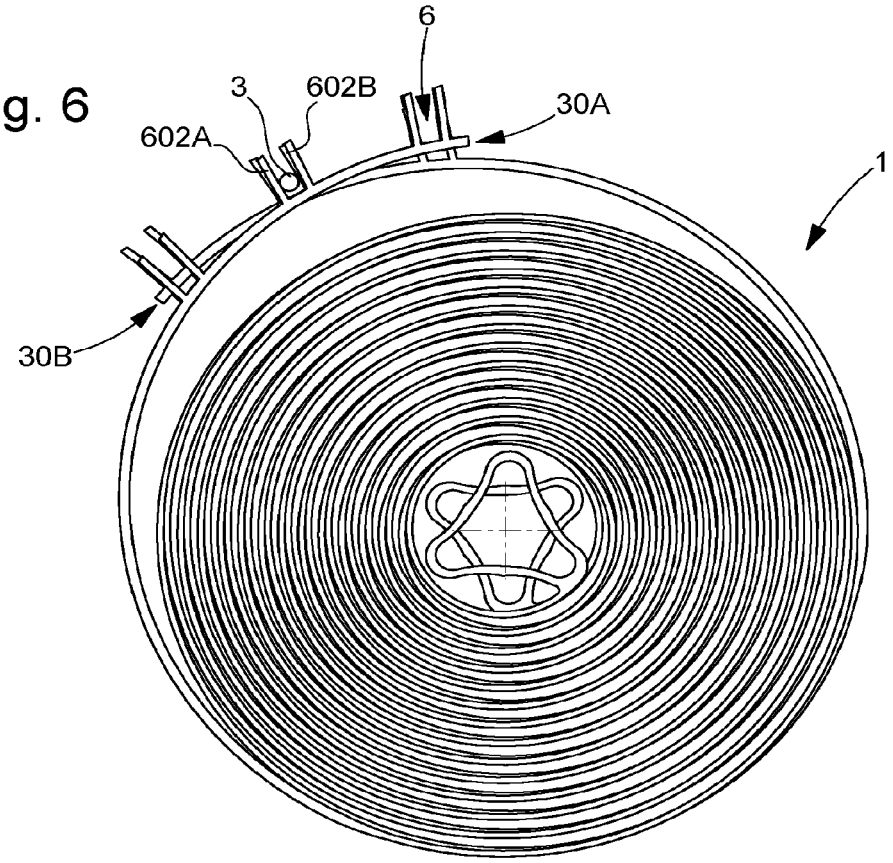
FIG. 6 shows a schematic view in projection in a plane parallel to the planes in which the three stages extend, of the balance spring of FIG. 5, in the same specific position.
Figure 7:
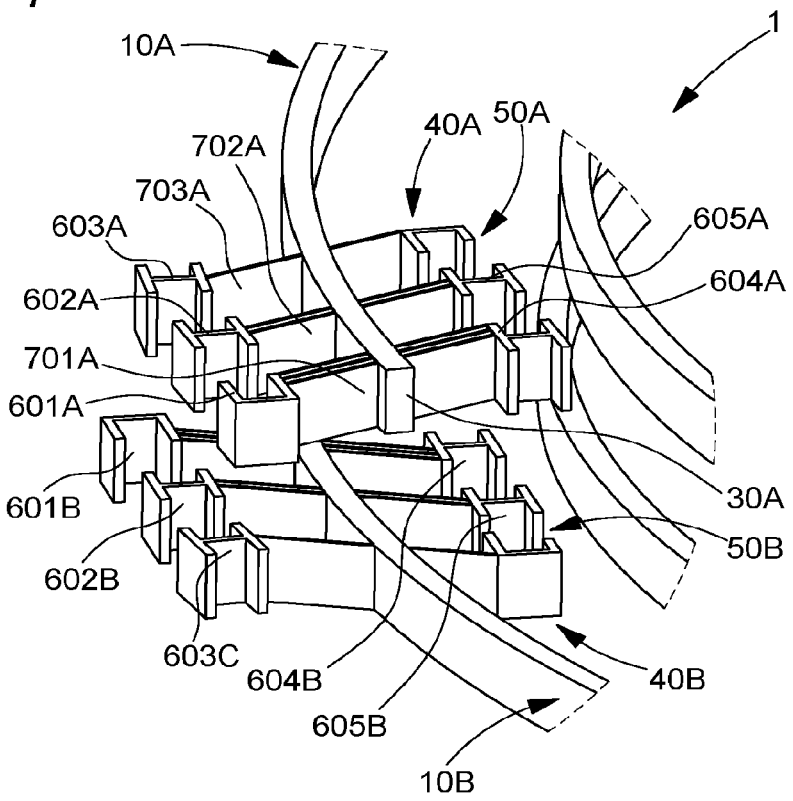
FIG. 7 shows a schematic perspective view of another variant of the balance spring of the invention, including two stages of coils, and wherein the adjustment and attachment means form a matrix structure allowing for extensive adjustment possibilities for each coil, shown with the coils in a free state.

One particular application, illustrated by FIGS. 5 and 6, includes three balance springs, which are attached to the collet at non-aligned points, for example at 120° from each other, and offset in height.

In a simple variant of the invention with two stages, illustrated in FIGS. 1 to 4 and 7 to 10, each stage 10, 10A, 10B includes, at its respective inner end 30, here 30A, 30B, its own means 40 for attachment to a stud, here 40A, 40B, which are independent of those of said other stages.

Figure 2:
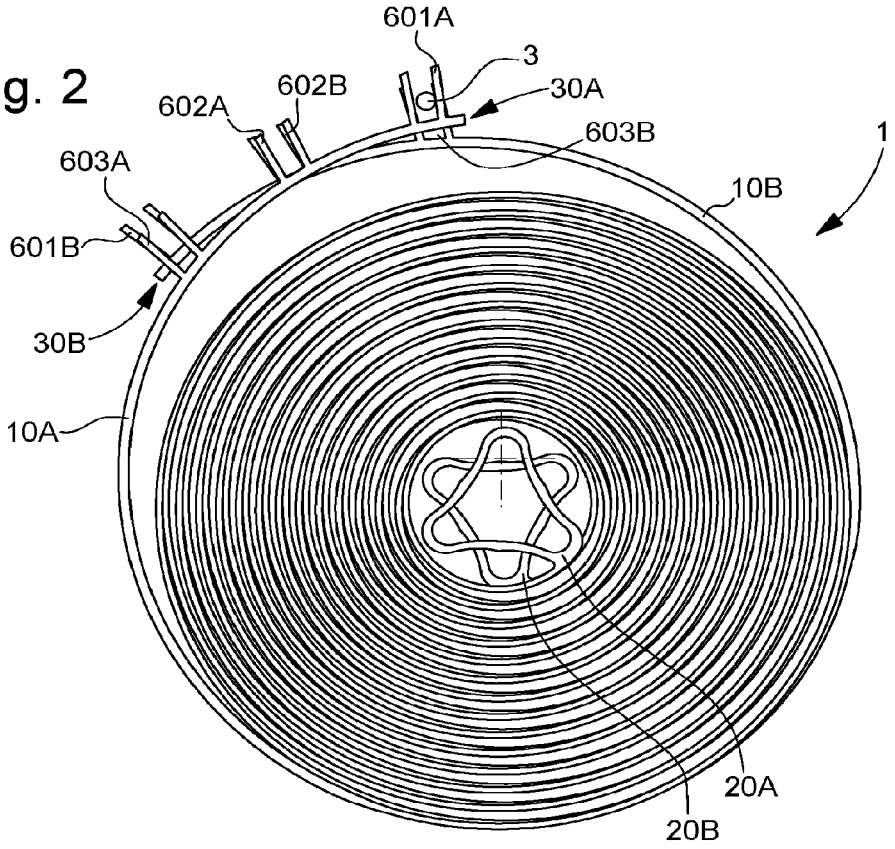
FIG. 2 shows a schematic view in projection in a plane parallel to the planes in which the two stages extend, of the balance spring of FIG. 1, in the same first position.
Figure 3:
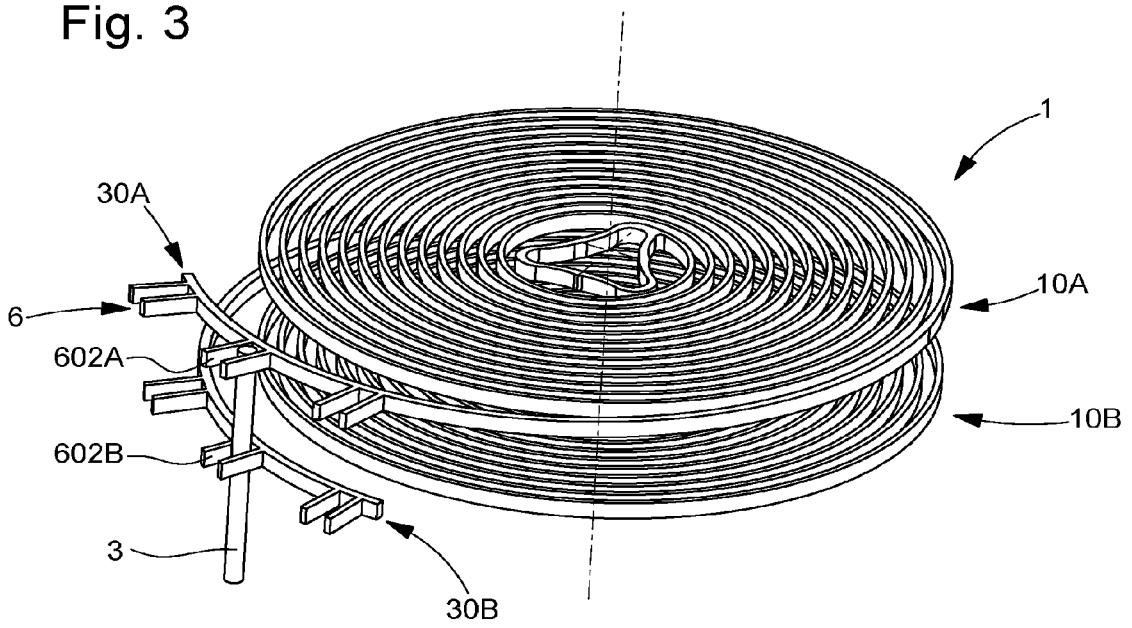
FIG. 3 shows a similar view to FIG. 1 of the same balance spring, in a second adjustment position.
Figure 4:
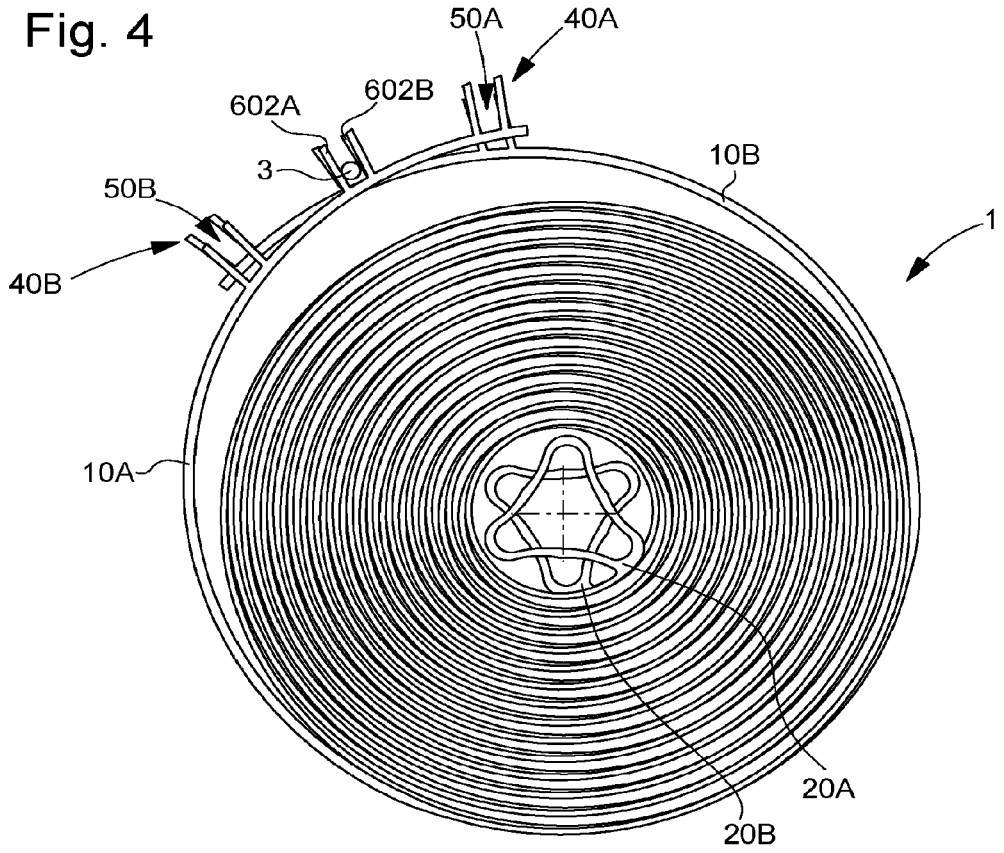
FIG. 4 shows a similar view to FIG. 2 of the same balance spring, in the second position of FIG. 3.

To avoid overloading FIGS. 1 to 3, stud 3 is not shown in detail in the Figures, nor is its attachment to the bottom plate or bridge, as appropriate.

Figure 9:
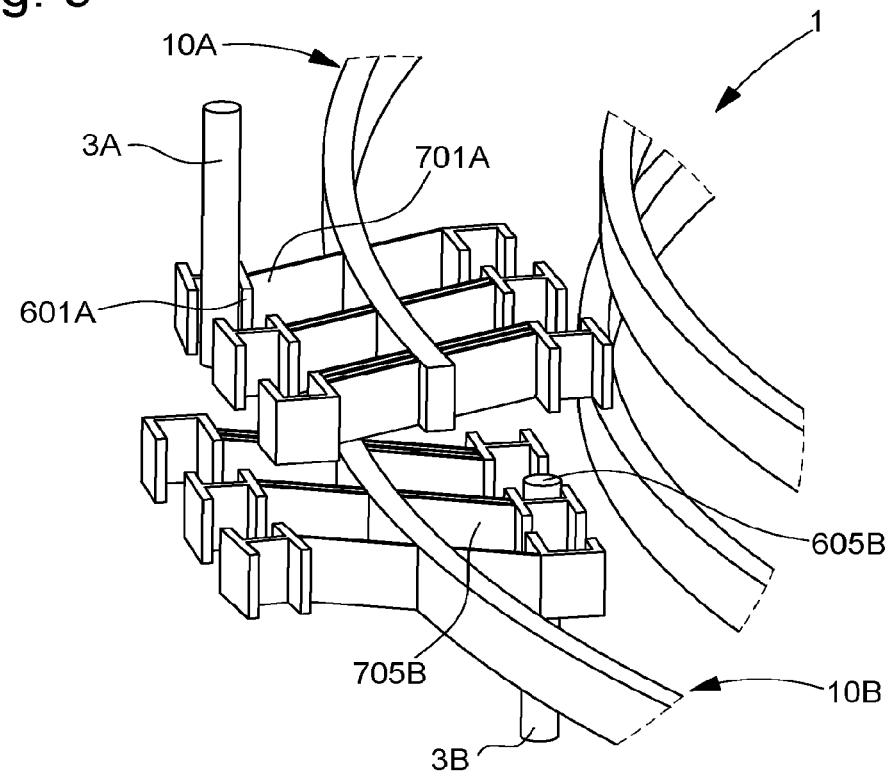
FIG. 9 shows a similar view to FIG. 8 of the same balance spring in a position wherein each coil cooperates with a distinct stud.
Figure 10:
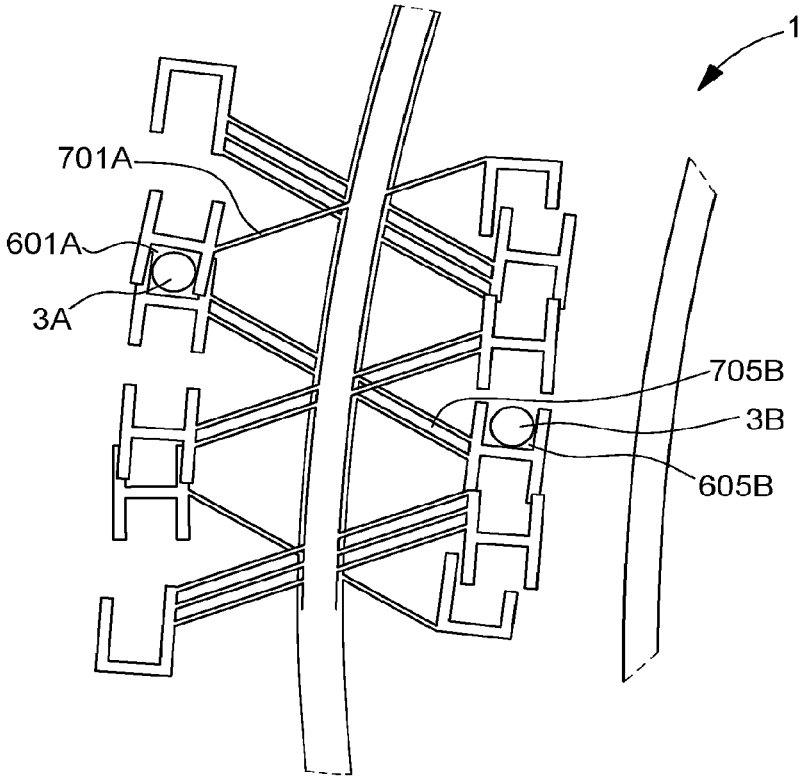
FIG. 10 shows a schematic view in projection in a plane parallel to the planes in which the two stages extend, of the balance spring of FIG. 9, in the same specific position.

The invention can be used both in an arrangement with a single stud 3, with which all the superposed stages cooperate, and in an arrangement where one particular stud corresponds to each stage 10. It is this variant that is illustrated in FIGS. 9 and 10: a stud 3A, for example integral with a bridge, cooperates with an upper stage 10A of balance spring 1, and another stud 3B, for example integral with a bottom plate, cooperates with a lower stage 10B of balance spring 1. These attachment means 40, 40A, 40B include means 50 for position adjustment with respect to a stud, here 50A, 50B, which are also independent of those of the other stages.

Thus, each stage can be adjusted independently of the others, and also attached independently of the others.

Preferably, these position adjustment means 50, of a given stage 10, include a plurality of discrete position adjustment positions 60, which form as many counting points.

In the simplified and non-limiting version illustrated by the Figures, these discrete positions correspond to U-shaped or similar housings 6, each arranged to retain one stud 3. Making the balance spring of micromachinable material allows for more complex geometries, in particular with omega or similar shaped housings forming a clamp, between flexible deformable walls, upon insertion of the stud in the housing selected by the watch adjuster or by a robot determining the optimum adjustment position, these walls then being arranged to retain the stud securely after insertion.

In the embodiment illustrated by FIGS. 1 to 6, position adjustment means 50 are disposed, for each stage 10A/B/C, in a ladder arrangement on only one side of the length of spring concerned, and are essentially devised for modification of the useful length and stiffness of the stage concerned.

In the more complex embodiment illustrated by FIGS. 7 to 10, the adjustment means offer each stage the possibility of positioning a stud in a matrix structure, in a type of grid or network, with compartments 601A to 605A or 601B to 605B, disposed in two substantially parallel rows, on either side of the length of spring concerned: it is thus possible to act both upon the length and upon the radial position to select the point of attachment. More complex embodiments, with more matrix lines and columns, are easy to produce thanks to the use of micromachinable material, the only limiting factor being the accessibility of the stud and access for the positioning tool.

Figure 8:
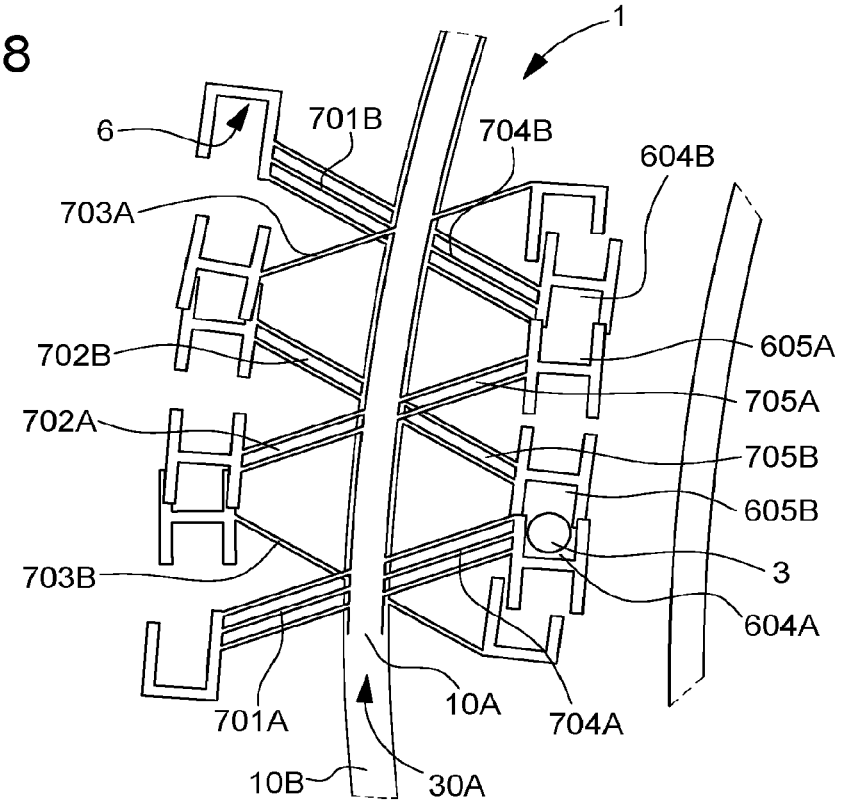
FIG. 8 shows a schematic view in projection in a parallel plane to the planes in which the two stages extend, of the balance spring of FIG. 7, in a specific adjustment position with respect to a single rectilinear stud parallel to the axis of the balance spring.

The example of FIG. 8 shows a single stud 3 cooperating with housings 604A of stage 10A and 605B of stage 10B, which hold it like a clamp. The example of FIG. 10 shows a housing 601 of stage 10A which cooperates with a first stud 3A, while a housing 605B of stage 10B cooperates with a second stud 3B. In the same example, attachment means 40 includes stop hooks for each compartment, in the shape of a U or H with a main axis parallel to the length of spring, and arranged to immobilise the stud concerned against the return torque of the stage 10 concerned. It is possible, after the adjustment operations, to subsequently bond housings 6 to stud 3, for example by adhesive bonding. In a particular and advantageous variant, the U or similar shaped profile, includes lugs to snap fit the U onto stud 3, thereby avoiding the need for adhesive bonding.

Attachment means 40 and position adjustment means 50 therefore together form built-in isochronism correction means for balance spring 1.

FIGS. 7 to 10 thus illustrate a particular variant, wherein attachment means 40 are of variable stiffness depending on the position of position adjustment means 50. In this variant, position adjustment means 50 of a given stage 10 include a plurality of elastic multi-arm assemblies 70, which also define the discrete position adjustment positions 60 set out above, and which support housings 6.

In the specific application of FIGS. 7 to 10, elastic multi-arms 70 are of a different stiffness from each other. The elastic multi-arms 70 are illustrated here with parallel flexible arms, permitted by the method for production of balance spring 1. They are arranged in groups of decreasing or increasing stiffness, with three strips 701A, 704A, 701B, then two strips 702A, 702B, and finally one strip 703A, 703B, in the particular non-limiting case of the Figures. It is understood that the stiffness of the outermost segment of each stage 10 is adjusted at will by selecting the stiffness of the final elastic multi-arm, and it is therefore possible to adjust the variable stiffness of the entire balance spring 1. The stiffness of these elastic arms may, depending on the case, be selected to decrease from the outer end 30 of the stage concerned, as in the case of the Figures, or vice versa, or in another manner.

These elastic multi-arms 70 with several strips can more quickly change the stiffness of the various balance springs, with the change of angular position.

It is, however, possible to choose a simplified variant, not illustrated by the Figures, where it is only the relative position of the stud and of position adjustment means 50 of a determined stage that are adjusted. Position adjustment means 50 of a given stage 10 may thus include a plurality of elastic multi-arm assemblies 70, which are all of the same stiffness.

In the variant of FIGS. 7 to 10, the elastic multi-arm assemblies 70 each include at least one inner point of attachment on a first inner area, and at least one outer point of attachment on a second outer area, further from the pivot axis of balance spring 1 than the first area, which provides highly differentiated positions of the stud concerned with respect to the stage.

Preferably, discrete positions 60 are angularly offset with respect to the axis of the balance spring, by a constant pitch comprised between 4° and 12°.

In the example illustrated by FIGS. 1 to 6, discrete positions 60 are angularly offset by a constant pitch comprised between 8° and 12° , notably close to 10°.

In the example illustrated by FIGS. 7 to 10, discrete positions 60 are angularly offset by a constant pitch comprised between 4° and 6° , notably close to 5° with respect to the pivot axis of balance spring 1.

In a particular variant, the respective attachment means 40 of at least two stages 10, in the free state, are superposed on each other.

Advantageously, to allow for differential adjustment of the various stages, and thus to better adjust the resulting stiffness of balance spring 1, at least two stages 10 include springs of a different stiffness from each other.

More particularly, at least two stages 10 include springs having a different section from each other.

Similarly, in a particular variant, at least two stages 10 include springs having a different active length from each other.

Also similarly, in a particular variant, at least two stages 10 include springs in different silicon oxidation states from each other, for example one in a non-oxidised silicon state, and the other in an oxidised silicon state.

In a particular variant, at least two stages 10 include springs wound in opposite directions. This is the case in all the Figures.

Preferably, the total stiffness of all the stages 10 wound in a first direction is equal to the total stiffness of all the stages 10 wound in a second direction, opposite to the first direction.

As a result of the invention, once the balance spring 1 is assembled, it is possible to modify the active attachment position, even when the balance spring is already assembled to a balance and inside a movement.

FIGS. 5 and 6 illustrate an advantageous variant with three superposed spring stages 10A, 10B, 10C. As previously, each includes an inner end 20A, 20B, 20C, and an outer end 30A, 30B, 30C, and attachment means, which include position adjustment means, which are not referenced to avoid overloading the Figures. In these Figures, the position adjustment means include housings 6 which are U-shaped profiles here and arranged to cooperate with a stud 3 of rectangular or square section; this example of the stud section and profile shape is non-limiting. In this particular variant, stud 3 is straight and parallel to the common axis of the various spring stages. This version is very easy to produce and thus very economical.

In this non-limiting variant of FIGS. 5 and 6, housings 6: 601A, 602A, 603A, 601B, 602B, 603B, 601C, 602C, 603C of the position adjustment means all include an opening to the outside. FIG. 5 shows a particular fastening position where housings 602A, 602B, and 602C cooperate with a common stud 3. Adjustment changes are easy, since each balance spring can be conveniently compressed to permit a change in the fastening position of the stud concerned. Most importantly, this particular arrangement allows for an adjustment on one of the stages independently of adjustments on the other stages, in a quite convenient manner for the operator performing the adjustment.

Figure 11:
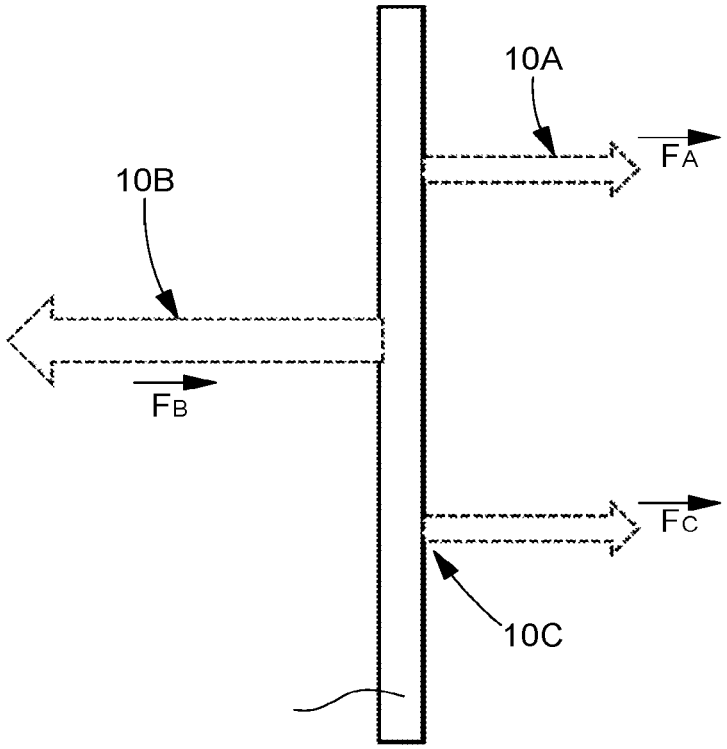
FIG. 11 shows a schematic view of the system of stresses applied to the single stud cooperating with the three-stage balance spring of FIG. 5.
Figure 12:
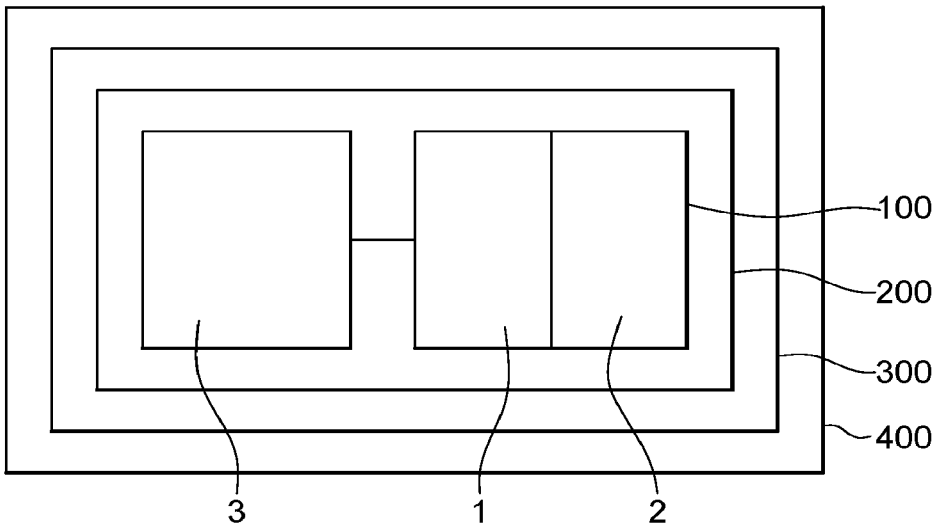
FIG. 12 is a block diagram representing a watch comprising a timepiece movement which includes a stud and a sprung balance assembly comprising a balance spring according to the invention.

FIG. 11 illustrates the preferred case where the resultant of the forces restored to the stud is zero, this is the case of a spring with three stages, the upper stage 10A and lower stage 10B being identical and wound in the same direction, and each having half the stiffness of the median stage 10B, which is wound in the opposite direction. Stresses FA and FC are exerted on either side of stress FB in the opposite direction, substantially in a tangential plane to the ends of the springs, and parallel to the common axis of the springs, the resulting torque is thus minimised, or even zero.

This configuration of the invention can increase the stiffness of one balance spring stage by reducing the stiffness of the other balance spring stages accordingly, or vice versa.

Also, in the particular and preferred case where the stiffness of the two most flexible springs is half the stiffness of the stiffest spring, the mean frequency remains the same, for all the configurations of attachment of the balance spring stages to stud 3.

In these different implementation variants of the invention, it is therefore possible to effect adjustment of the mean frequency and of the isochronous gradient.

In particular, when the means for attachment to a single stud are superposed, during modification of the active attachment, the stiffness of the two stages 10A and 10B of the illustrated variants changes in an opposite manner: the spring of one stage becomes stiffer, while the other becomes less stiff. The geometry of the two springs can thus be defined and adjusted, so that the total resulting stiffness, and thus the oscillation frequency of the sprung balance formed with a balance spring 1 according to the invention, barely changes during the procedure for adjustment of the isochronous gradient. In such case, the usual adjustment of the balance screws can still set the mean frequency of the sprung balance assembly.

Conversely, modification of the isochronous gradient as a function of the position of attachment remains important, and can correct manufacturing or assembly errors, for example adhesive bonding errors.

The invention also concerns a sprung balance assembly 100, comprising a balance 2 coupled with at least one such balance spring 1.

The invention also concerns an escapement mechanism 200, comprising at least one such sprung balance assembly 100, and comprising at least one stud 34 for fastening in position the outer end 30 of at least one said stage 10.

As explained above, in a first variant, at least one same stud 3 is arranged to fasten several outer ends 30 of different stages 10. Whereas in a second variant, escapement mechanism 200 comprises a separate stud 34 for fastening in position the outer end 30 of each stage 10.

The above explanation concerns the shape of the balance springs.

The solution of a particular, single or combined stud, may also, alone or in combination with these particular balance springs, provide an original solution to the problem of adjustment for isochronism.

Indeed, acting on the outer, angular and/or radial position of attachment, for a plurality of balance springs, can also control isochronism.

In particular, one may consider the variant with at least two independent studs, as seen in FIGS. 9 and 10, which may be used, either with the balance springs described above, or with conventional balance springs. Of course, the movability of the studs complicates the fabrication of the bottom plates and bridges concerned, but is within the grasp of the watch designer who wishes to continue to use standard balance springs. It is to be noted that a particular advantage of the multistage balance springs 1 described above, is control of the thickness dimensions, which can be reduced to a strict minimum corresponding to the play necessary for operation and for operating safety.

Thus, in a particular variant, escapement mechanism 200 comprises at least one stud 3 whose position is movable and adjustable, for fastening in position the outer end 30 of at least one stage 10.

In a particular variant, escapement mechanism 200 comprises at least one stud 3 whose position is movable and adjustable, for fastening in position the outer end of at least one standard balance spring, i.e. comprising a single outer coil running on from the coils of the winding, in no particular arrangement, and of similar or identical section to that of the other coils. Naturally, this arrangement, which is applicable to a standard balance spring, is applicable to a multistage balance spring 1 as presented above.

More particularly, at least one such position adjustable stud is arranged to be capable of occupying one of a plurality of discrete positions in a bottom plate or a bridge comprised in escapement mechanism 200. In a particular embodiment, this stud can be fitted inside one housing or bore in an array of known position holes which are reproducible from one mechanism to another.

Of course, such a stud arrangement can be applied generally to several independent studs, and notably in a variant with as many independent studs as there are balance springs.

Various specific arrangements of the attachment between the stud and the balance spring are possible, in particular in an embodiment made of micromachinable material, which makes it possible to make the attachments in a different manner from the multiple arms explained above, in the form of washers, or hollow lugs, or suchlike, which are quite advantageous solutions for silicon balance springs. The washers or suchlike can be directly incorporated in the mask.

Figure 13:
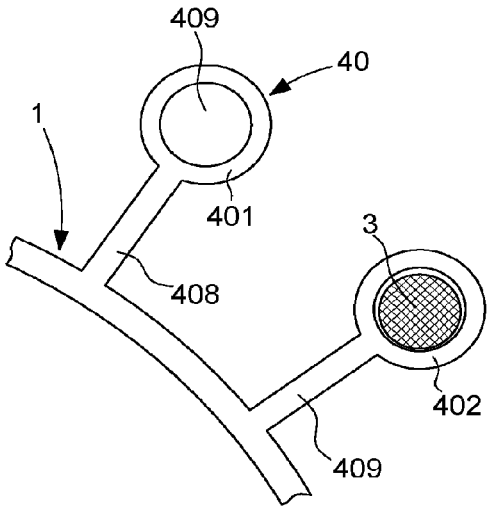
FIGS. 13 and 14 show schematic plan views of a detail of an annular stud attachment, in two different relative positions of the stud with respect to the balance spring.
Figure 14:
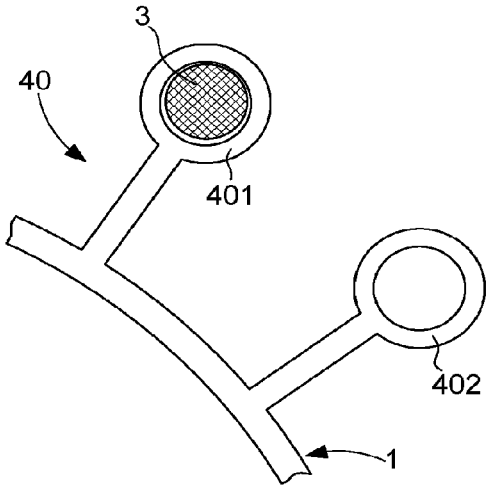
Figure 15:
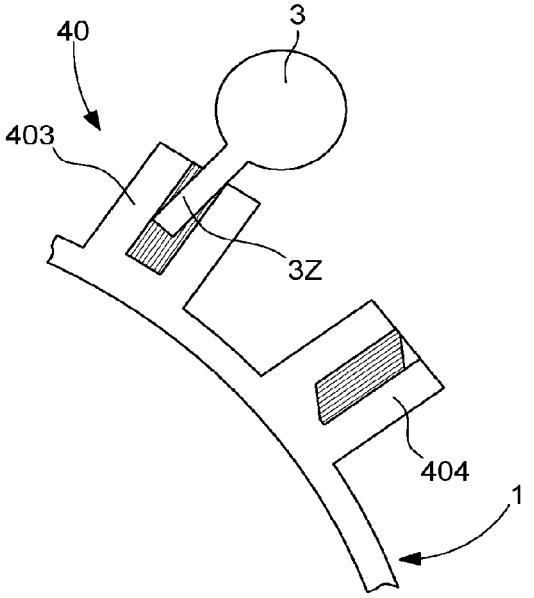
FIGS. 15 and 16 show schematic plan views of a detail of a stud attachment in a hollow of a block forming a protuberance of the balance spring, in two different relative positions of the stud with respect to the balance spring.
Figure 16:
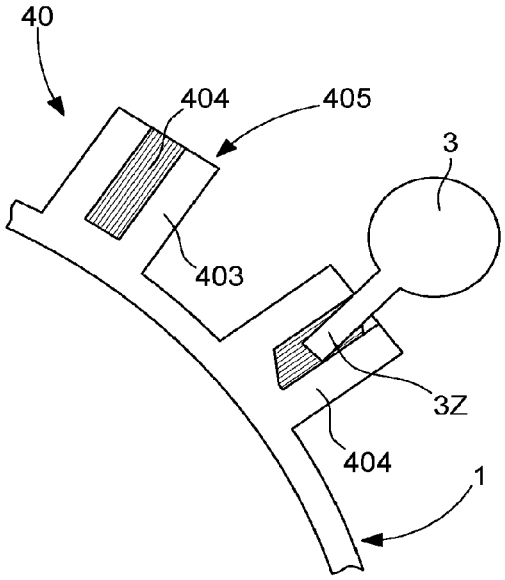
Figure 17:
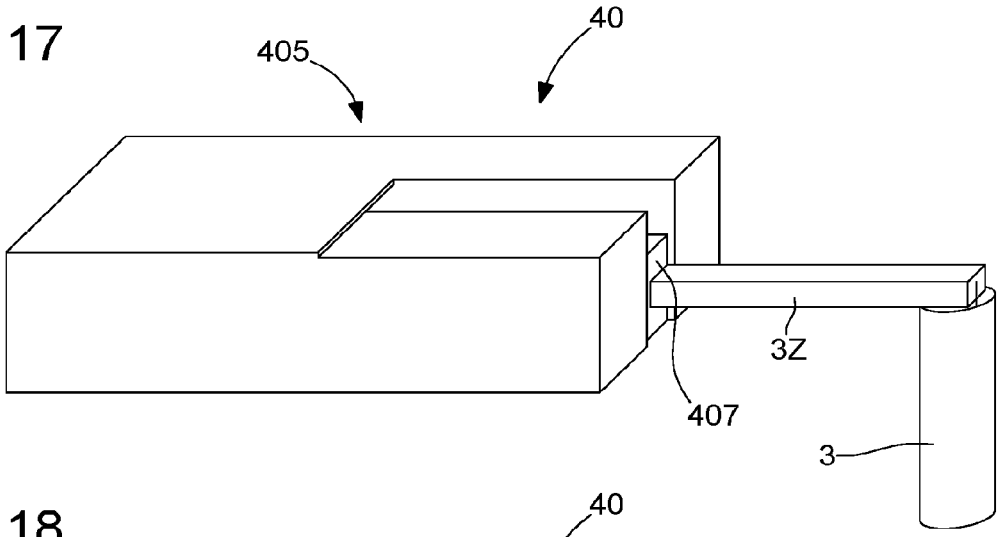
FIGS. 17 and 18 show perspective views of two examples of a stud tab retained in such a hollow.
Figure 18:
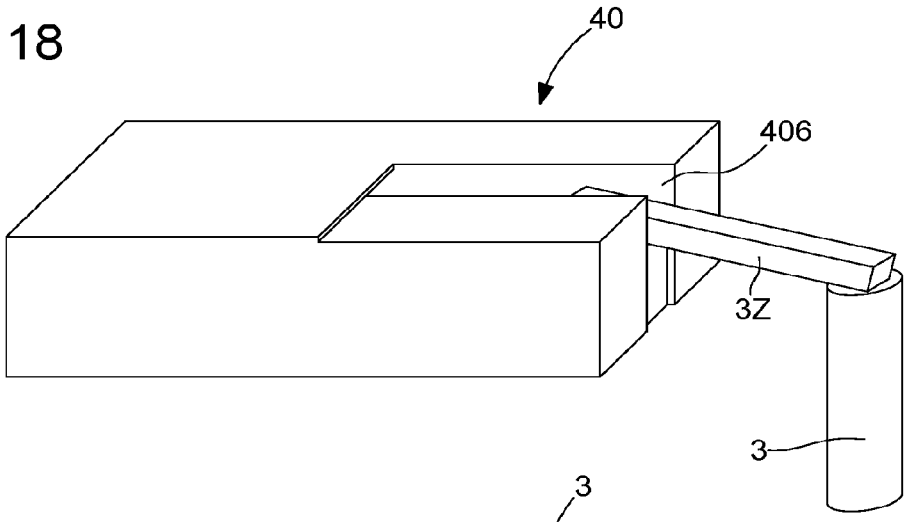

A first variant, shown in FIGS. 13 and 14, comprises attachments 401, 402, which have through holes 409, making a purely mechanical attachment to stud 3 very easy, and which may even avoid the need for adhesive bonding between the stud and the balance spring. More particularly, these annular attachments 401, 402, are at the end of connecting strands 408, 409, which may be of a different stiffness from each other.

In a second variant, shown in FIGS. 15 to 18, balance spring 1 has lugs 405 in the form of blocks 403, 404, in which, during fabrication, non-through hollows 406 are made, in a non-limiting example by etching an excess thickness of oxide. When normally the thickness of oxide on a silicon spring is between 5 and 10 micrometres, it is here possible to use springs with a more important thickness of oxide, particularly between 20 and 30 micrometres. In such case, a stud 3 comprising at least one resilient leaf on a tab 3Z comprised therein can clamp the desired lug 405. A variant uses two such resilient leaves in order to maintain the spring in position during gluing if this spring is glued in position. It is possible to hold the spring only with such resilient leaves for measuring of the run in the horizontal positions, and the possible gluing is made only after all the adjustments, in order to provide a good resistance to the schocks. Naturally, at least one resilient leaf 407 may also be made inside the hollow, for retention of a stud 3 or of such a tab 3Z.

Figure 19:
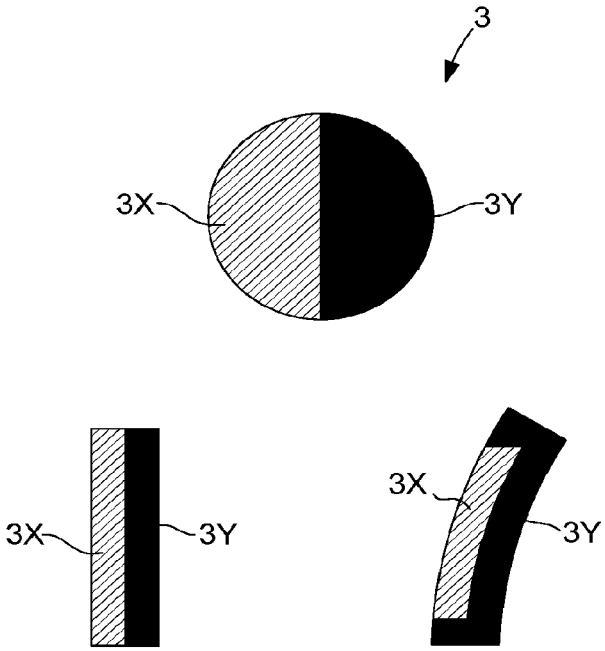
FIG. 19 shows a schematic, cross-sectional and side view, in two different thermal states T1 and T2, of a bimaterial stud arranged to achieve temperature compensation of the oscillator.

In order to achieve temperature compensation of the oscillator, an advantageous variant, shown in FIG. 19, consists in using bimaterial resilient studs 3, each stud having a different relative thickness of the two materials 3X and 3Y. The stud is made in the manner of a bimetallic attachment, and deforms, due to the different coefficient of thermal elongation of the two component materials, preferably in the direction of the coil, to cause a difference in tension in the two balance springs. This solution makes it possible to adjust the active length of each balance spring to ensure the correct isochronous gradient and mean rate, and thus to ensure that the change in stiffness due to temperature variations always conforms to the change in inertia of the balance (whereas, generally, changing the active length and thus the stiffness of the balance spring also changes the dependence of its stiffness on temperature).

In a particular embodiment, escapement mechanism 200 has no index assembly.

The invention also concerns a mechanical timepiece movement 300 including at least one escapement mechanism 200 of this type.

The invention also concerns a watch 400 including at least one such mechanical timepiece movement 300.

In short, the invention allows the watchmaker to finely adjust the isochronism of a combined balance spring, made of a non-plastically deformable material, such as silicon derivatives, by replacing the index system normally used for a steel balance spring.

What is claimed is:

1. A timepiece balance spring made of micromachinable material comprising a plurality of stages, each forming a spiral wound spring, all parallel to each other and arranged to be assembled to each other at the respective inner ends thereof in a common axial collet or on the same balance staff, wherein each said stage includes, at the respective outer end thereof, specific means of attachment to a balance spring stud which are independent of those of said other stages, said means of attachment comprising means for position adjustment with respect to a balance spring stud which are also independent of those of said other stages, said means of attachment and said means for position adjustment together forming built-in isochronism correction means for said balance spring, wherein said position adjustment means of a said stage include a plurality of discrete position adjustment positions comprising housings each arranged to retain a stud.

2. The timepiece balance spring according to claim 1, wherein said means of attachment are of variable stiffness depending on the position of said position adjustment means.

3. The timepiece balance spring according to claim 1, wherein said position adjustment means of a said stage include a plurality of elastic multi-arms defining said discrete position adjustment positions.

4. The timepiece balance spring according to claim 3, wherein said position adjustment means of a said stage include a plurality of elastic multi-arm assemblies which are of a different stiffness from each other.

5. The timepiece balance spring according to claim 3, wherein said position adjustment means of a said stage include a plurality of elastic multi-arm assemblies which are of the same stiffness as each other.

6. The timepiece balance spring according to claim 3, wherein said elastic multi-arm assemblies each include at least one inner point of attachment on a first inner area, and at least one outer point of attachment on a second outer area, further from the pivot axis of said balance spring than said first area.

7. The timepiece balance spring according to claim 3, wherein said elastic multi-arm assemblies each include a U-shaped housing facing the exterior of said balance spring.

8. The timepiece balance spring according to claim 1, wherein said discrete positions are angularly offset by a constant pitch comprised between 4° and 12° with respect to the pivot axis of said balance spring.

9. The timepiece balance spring according to claim 1, wherein at least two said stages include springs wound in opposite directions.

10. The timepiece balance spring according to claim 9, wherein the total stiffness of all of said stages wound in a first direction is equal to the total stiffness of all of said stages wound in a second direction opposite to said first direction.

11. The timepiece balance spring according to claim 1, wherein each said stage includes angular indexing means arranged to cooperate in a complementary manner with complementary indexing means, comprised in said other stages to form together said compound balance spring, in a fixed and reproducible geometry.

12. An escapement mechanism including at least one sprung balance assembly comprising a balance coupled to at least one said balance spring according to claim 1, and comprising at least one stud for fastening in position said outer end of at least one said stage.

13. The escapement mechanism according to claim 12, wherein at least one said same stud is intended for the attachment of several said outer ends of said different stages.

14. The escapement mechanism according to claim 13, wherein the mechanism includes one said rectilinear stud parallel to the axis of said balance spring.

15. The escapement mechanism according to claim 12, wherein at least one said stud is made in the manner of a bimetallic attachment with two materials of different coefficients of thermal elongation, and is arranged to deform in the direction of the coil of said balance spring, one end of which is carried by said stud.

16. A mechanical timepiece movement including at least one escapement mechanism according to claim 12.

17. A watch including at least one mechanical timepiece movement according to claim 16.

* * * * *